US007521626B2

(12) United States Patent
Muramatsu

(10) Patent No.: US 7,521,626 B2
(45) Date of Patent: Apr. 21, 2009

(54) AUTOMATIC PLAYER MUSICAL INSTRUMENT, TESTING SYSTEM INCORPORATED THEREIN AND METHOD FOR SPECIFYING HALF PEDAL POINT

(75) Inventor: Shigeru Muramatsu, Shizuoka-Ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 11/735,515

(22) Filed: Apr. 16, 2007

(65) Prior Publication Data

US 2007/0256550 A1 Nov. 8, 2007

(30) Foreign Application Priority Data

Apr. 24, 2006 (JP) ..... 2006-118976

(51) Int. Cl.
*G10H 1/32* (2006.01)

(52) U.S. Cl. ..... 84/719; 84/626

(58) Field of Classification Search ..... 84/719, 84/626, 473, 724
See application file for complete search history.

(56) References Cited

U.S. PATENT DOCUMENTS 5,523,522 A 6/1996 Koseki et al.
5,585,588 A * 12/1996 Tumura ..... 84/726
2006/0021488 A1 * 2/2006 Fujiwara et al. ..... 84/13

* cited by examiner

*Primary Examiner*—Kawing Chan
(74) *Attorney, Agent, or Firm*—Harness, Dickey & Pierce, PLC

(57) ABSTRACT

A testing system is incorporated in an automatic player piano for specifying a half pedal point of a damper pedal at which the loudness of tones is lessened, and an automatic player moves the damper pedal to the half pedal point so as to lessen the loudness of tones in an automatic playing; the testing system accumulates pieces of experimental data expressing relation between the loudness of tones and a current pedal position of the damper pedal, and searches the pieces of experimental data for points of reflection; and the testing system determines the half pedal point through an internal division on the line between the points of reflection.

20 Claims, 11 Drawing Sheets

AUTOMATIC PLAYER MUSICAL INSTRUMENT, TESTING SYSTEM INCORPORATED THEREIN AND METHOD FOR SPECIFYING HALF PEDAL POINT

FIELD OF THE INVENTION

This invention relates to an automatic player musical instrument and, more particularly, to an automatic player musical instrument capable of re-producing a half-pedal in a playback and a method for determining half pedal region, a testing system for determining the half pedal point and a method for determining the half pedal point.

DESCRIPTION OF THE RELATED ART

An automatic player piano is a typical example of the automatic player musical instrument, and is broken down into an acoustic piano and an automatic playing system. The automatic playing system includes a controller, solenoid-operated key actuators and solenoid-operated pedal actuators, and the solenoid-operated key actuators and solenoid-operated pedal actuators are respectively provided in association with the array of black keys and white keys incorporated in the acoustic piano and the pedals of the acoustic piano. While the automatic playing system is reenacting a performance on the acoustic piano, the controller sequentially supplies key driving signals to the solenoid-operated key actuators so as to give rise to the key movements as similar to the original performance. The controller further supplies pedal driving signals to the solenoid-operated pedal actuators so as to move the pedals over the stroke equal to that in the original performance. Thus, the automatic playing system makes the predetermined pedal effects imparted to the acoustic piano tones.

One of the pedals is called as a "damper pedal". Pianists can give two pedals effects to the acoustic piano tones by means of the damper pedal. A pianist is assumed to make the damper pedal remain at the rest position. The dampers are held in contact with the associated strings on the condition that the black keys and white keys stay at the rest positions, and the dampers prevent the strings from vibrations. The pianist is assumed to depress a white key. The white key causes the damper spaced from the string on the way toward the end position, and the damper permits the associated string freely to vibrate. When the associated action unit escapes from the hammer, the hammer starts to rotate toward the string. The hammer is brought into collision with the string, and gives rise to vibrations. The acoustic piano tone is produced through the vibrations of strings. The damper is brought into contact with the vibrating string on the way toward the rest position, and the vibrations and, accordingly, the acoustic piano tone are decayed. Thus, the dampers behaves as usual on the condition that the damper pedal stays at the rest position. Any pedal effect is not imparted to the acoustic piano tones. The region of pedal stroke to cause the damper fully to exert the weight on the string is hereinafter referred to as a "restricting region".

When the pianist depresses the damper pedal to the end position, the damper remains spaced from the strings after release of the depressed keys so that the acoustic piano tones are prolonged. This pedal effect is hereinafter referred to as a "full stroke pedal effect". The region of pedal stroke to make the dampers perfectly spaced from the strings is referred to as a "damper-free region".

If the pianist keeps the damper pedal on the way to the end position, the dampers have removed part of the weight thereof from the associated strings, but are still in contact with the strings. In this situation, the depressed keys cause the associated hammers to be brought into collision with the strings, and give rise to the vibrations of strings. However, the dampers do not allow the strings freely to vibrate. As a result, the acoustic piano tones are produced from the weakly vibrating strings at small loudness. This pedal effect is hereinafter referred to as a "half pedal effect", and the range of pedal stroke to impart the half pedal effect is referred to as a "half pedal region".

In order to produce the acoustic piano tones at high fidelity, the pedals of acoustic piano are to be moved in such a manner that the pedal effects are exactly imparted to the acoustic piano tones. In case where an original performance is recorded on the acoustic piano combined with the automatic playing system, the controller is only expected to move the pedals over the stroke equal to that in the original performance. However, if the automatic playing system reenacts the original performance on an acoustic piano different from the acoustic piano used for the recording, there is a possibility that the pedal effects, which are different from those in the original performance, may be imparted to the acoustic piano tones, because the half pedal region of another acoustic piano is not equal to that of the acoustic piano used in the original performance.

In order to reproduce the acoustic piano tones at high fidelity, the restricting region, half pedal region and full stroke region are to be individually determined through a test before the automatic playing.

A prior art testing method is disclosed in Japanese Patent No. 2606616. According to the Japanese Patent, the controller stepwise increases the duty ratio of driving pulse signal, and measures the pedal stroke. Although the duty ratio is constantly increased, the rate of change in the pedal stroke is varied. Although the weight of damper is born by the strings in the restricting region, the load on the strings is gradually decreased in the half pedal region, and, finally, all the load are born by the foot of the player. For this reason, the rate of change is to be smaller in the half pedal region rather than that in the restricting region. The controller accumulates pieces of pedal stroke data expressing the ascent of the plunger of solenoid-operated pedal actuator, and searches the pieces of pedal stroke data for the point of inflection so as to determine the boundary between the restricting region and the half pedal region at the point of inflection.

However, the point of inflection is not clearly discriminative. Therefore, the result of the prior art test is not reliable. In other words, it is hard exactly to specify the boundary of the half pedal region through the prior art method.

As well know to the persons skilled in the art, the dampers for the strings in the lower pitched part are larger and heavier than the dampers for the strings in the higher pitched part are, and the array of dampers are supported by the lifter bar at a middle point of the array. When the damper pedal is depressed, the force is transmitted to the lifter bar, and the lifter bar pushes the array of dampers, upwardly. Although the dampers for the strings in the higher pitched part are promptly lifted up, the dampers for the strings in the lower pitched part tend to be left on the associated strings. On the contrary, while the damper pedal is returning to the rest position, the dampers for the strings in the lower pitched part are firstly brought into contact with the associated strings, and, thereafter, the dampers for the strings in the lower pitched part reach the associated strings. Irregularity is found in the movement of dampers, and the inflection point of a certain damper does not stand for the movement of the array of dampers. In fact, when the boundary of the half pedal region is determined at the inflection point, the boundary of the half pedal region is not always consistent with a boundary of the half pedal region decided by a human tuning worker.

SUMMARY OF THE INVENTION

It is therefore an important object of the present invention to provide an automatic player musical instrument, which exactly determines a half pedal point in the half pedal region of the acoustic musical instrument by itself.

It is another important object of the present invention to provide a testing system, which determines the half pedal point for the automatic player musical instrument.

It is also an important object of the present invention to provide a method for exactly determining the half pedal point in the half pedal region.

To accomplish the object, the present invention proposes to put a target position of a manipulator for imparting one of the effects imparted to tones by means of the manipulator on the basis of the magnitude of vibrations varied with a current position of the manipulator.

In accordance with one aspect of the present invention, there is provided an automatic player musical instrument for producing tones without a fingering of a human player comprising a musical instrument including plural manipulators selectively moved for specifying the tones to be produced, a tone generating system connected to the plural manipulators and producing the tones specified with the manipulators, another manipulator connected to the tone generating system, and imparting an effect selected from effects to the tones depending upon a current position of the aforesaid another manipulator, an automatic playing system provided in association with the plural manipulators and the aforesaid another manipulator so as selectively to move the plural manipulators for specifying the tones and the aforesaid another manipulator for imparting the effect to the tones, and a testing system determining a target position of the aforesaid another manipulator for imparting one of the effects to the tones through an experiment, informing the automatic playing system of the target position and including an exciter giving rise to at least one of the tones through vibrations in the tone generating system, a driver moving the aforesaid another manipulator for varying the current position, a converter converting vibrations expressing the at least one of the tones to pieces of experimental data expressing magnitude of the vibrations varied together with the current position and an information processor connected to the converter and determining the target position on the basis of at least one point of reflection found in plots expressing relation between the magnitude and the current position.

In accordance with another aspect of the present invention, there is provided a testing system determining a target position of a manipulator for imparting one of effects to tones produced in an automatic player musical instrument through an experiment, and the testing system comprises an exciter giving rise to at least one of the tones through vibrations in a tone generating system of the automatic player musical instrument, a driver moving the manipulator for varying a current position of the manipulator, a converter converting vibrations expressing the aforesaid at least one of the tones to pieces of experimental data expressing magnitude of the vibrations varied together with the current position and an information processor connected to the converter and determining the target position on the basis of at least one point of reflection in plots expressing relation between the magnitude and the current position.

In accordance with yet another aspect of the present invention, there is provided a method of specifying a target position of a manipulator incorporated in an automatic player musical instrument for imparting an effect to tones produced in the automatic player musical instrument, the method comprises the steps of a) giving rise to at least one tone in the automatic player musical instrument, b) moving the manipulator so as to vary a current position of the manipulator, c) accumulating pieces of experimental data expressing relation between magnitude of vibrations representative of the aforesaid at least one tone and the current position during the movement of the manipulator, d) searching the piece of experimental data for at least one point of reflection and e) specifying the target position on the basis of the at least one point of reflection.

The target position may be determined through an internal division on a line drawn between two points of reflection representative of boundaries of a certain region in which the effect is imparted to the tones.

BRIEF DESCRIPTION OF THE DRAWINGS

The features and advantages of the automatic player musical instrument, automatic playing system and method will be more clearly understood from the following description taken in conjunction with the accompanying drawings, in which.

DESCRIPTION OF THE PREFERRED EMBODIMENTS

Figure 1:
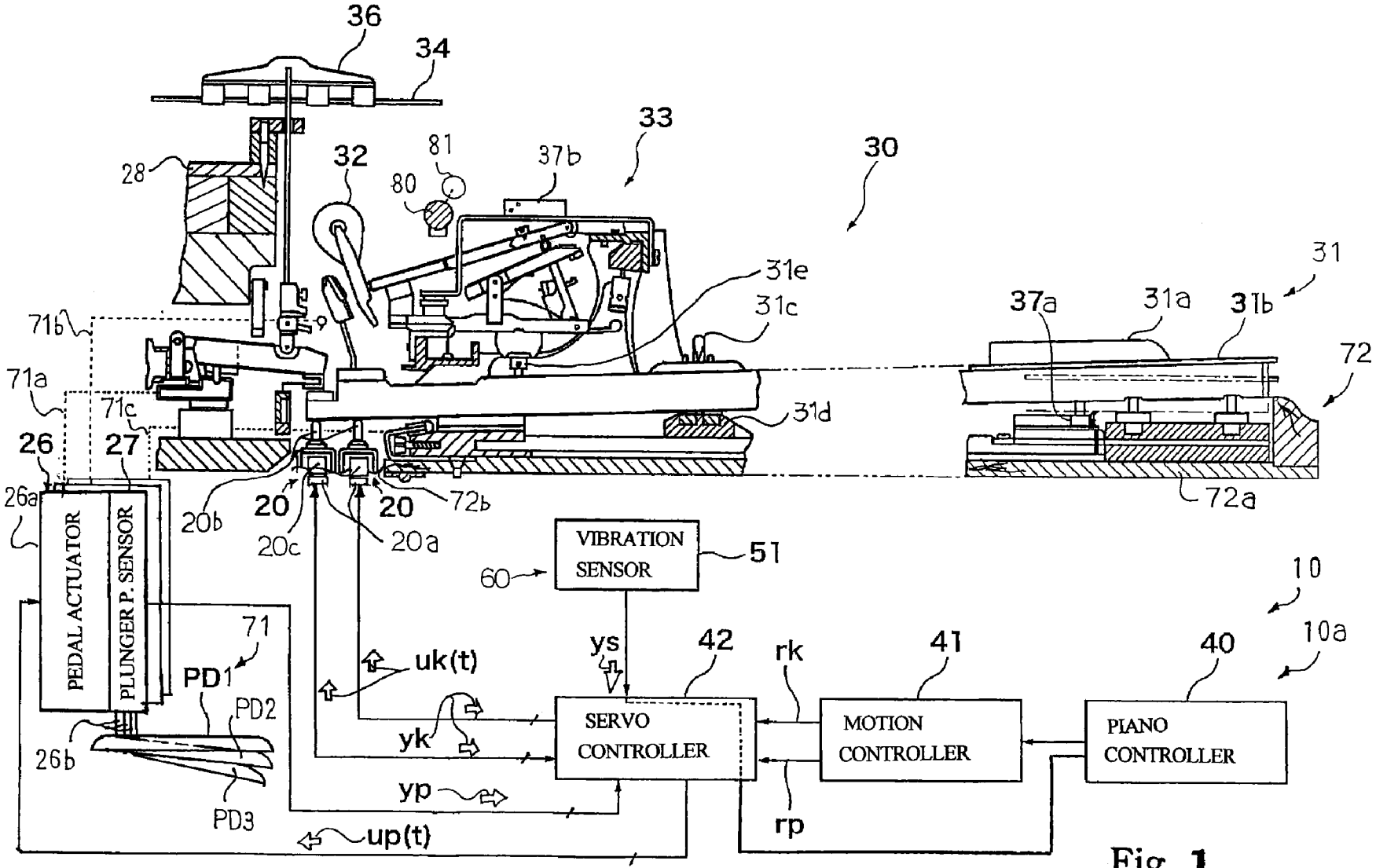
FIG. 1 is a schematic cross sectional view showing the structure of an automatic player piano embodying the present invention.
Figure 2A:
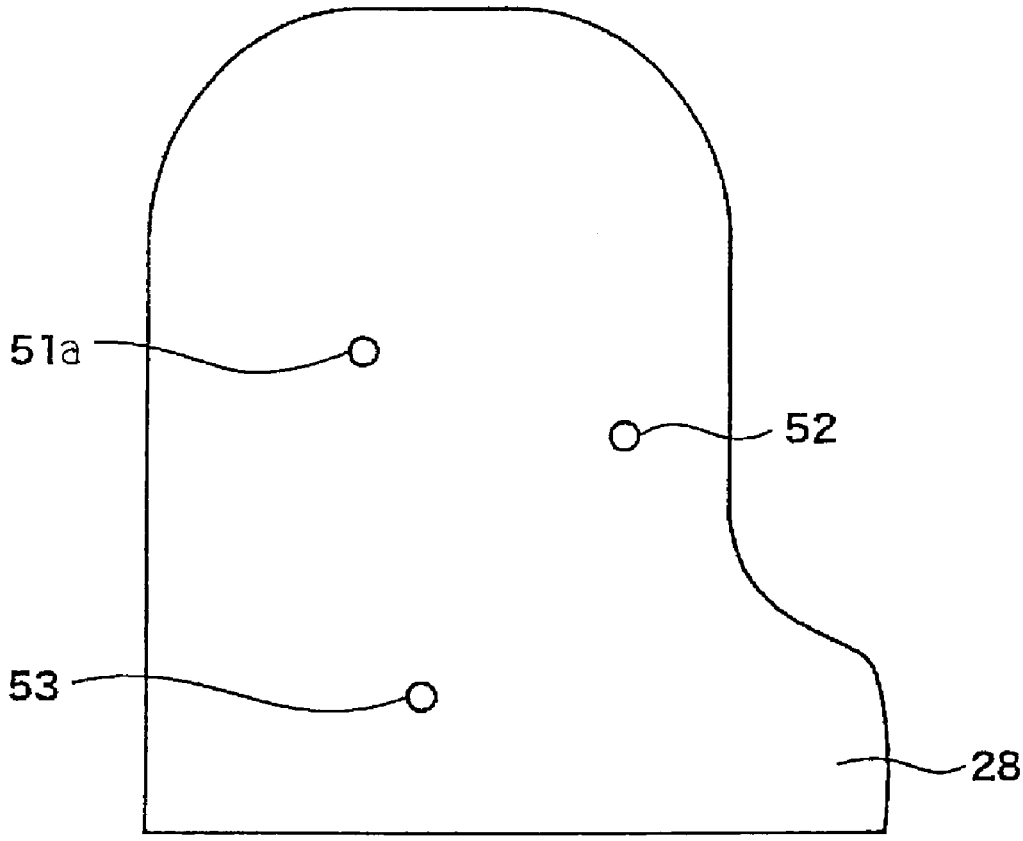
FIG. 2A is a plane view showing a vibration sensor on and over a sound board.
Figure 2B:
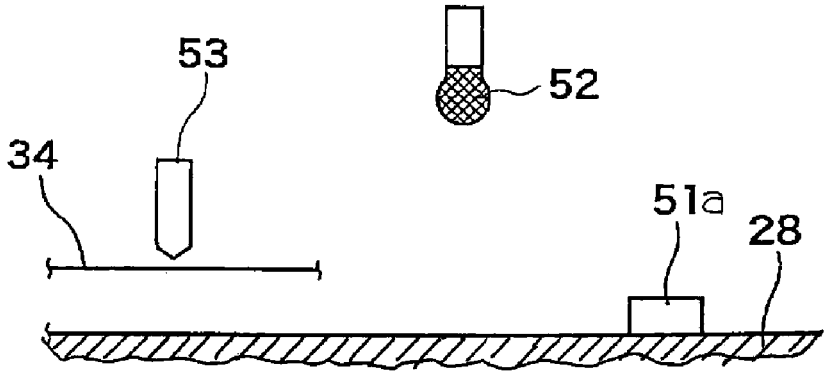
FIG. 2B is a side view showing the vibration sensor on and over the sound board.

An automatic player musical instrument embodying the present invention largely comprises a musical instrument, an automatic playing system and a testing system. The automatic playing system and testing system are installed in the musical instrument. A human player fingers a music tune on the musical instrument without any assistance of the automatic playing system, and the automatic playing system is used for producing tones without the fingering of human player.

The musical instrument includes plural manipulators, a tone generator and another manipulator. The plural manipulators are selectively moved by the human player or automatic playing system for specifying the tones to be produced. The plural manipulators are connected to the tone generating system, and the tone generating system produces the tones specified with the manipulators. The manipulator is also connected to the tone generating system, and the human player or automatic playing system imparts an effect to the tones. The manipulator is available for plural effects, and the tone generating system determines the effect to be imparted to the tones depending upon a current position of the manipulator.

It is important for the automatic playing system exactly to move the manipulator to a target position for imparting the effect imparted same as that in an original performance on the musical instrument. The target position is specifies by the testing system through an experiment, and informs the automatic playing system of the target position The testing system includes an exciter, a driver, a converter and an information processor. A particular feature of the testing system is directed to the information processing on pieces of experimental data expressing the magnitude of vibrations of tones. Human players and audience recognize the effect of tones through their ears. Similarly, the testing system specifies the target position on the basis of the vibrations of tones so that the effect imparted at the target position specified by the testing system is quite close to the effect recognized by the human players and audience.

In the experiment, the exciter gives rise to at least one of the tones through vibrations in the tone generating system, and the driver moves the manipulator in the generation of tone for varying the current position. The converter converts the vibrations expressing the tone to pieces of experimental data expressing magnitude of the vibrations varied together with the current position. The information processor is connected to the converter so as to accumulate the pieces of experimental data. The information processor determines the target position on the basis of at least one point of reflection found in plots expressing relation between the magnitude and the current position. Thus, the target position is determined on the basis of the magnitude of vibrations of tone. The target position thus determined is highly reliable.

In the following description, term "front" is indicative of a position closer to a human player, who sits on a stool for fingering, than a position modified with term "rear". A line drawn between a front position and a rear position extends in a "fore-and-aft direction", and a "lateral direction" crosses the fore-and-aft direction at right angle. An "up-and-down direction" is normal to a plane defined by the fore-and-aft direction and the lateral direction.

First Embodiment

An automatic player piano embodying the present invention largely comprises an automatic playing system 10, a grand piano 30 and a pedal testing system 60. A human player performs a piece of music on the grand piano 30 without any assistance of the automatic playing system 10. The automatic playing system 10 is installed in the grand piano 30, and reenacts a performance on the grand piano 30 without any participation of a human player. The pedal testing system 60 carries out a test on the grand piano 30, and determines a half pedal point in a half pedal region. In this instance, the half pedal point is expressed as a pedal stroke from the rest position in millimeters. The boundary between the restricting region and the half pedal region can serve as the half pedal point. The half pedal region has been hereinbefore described, and the half pedal point is an arbitrary point in the half pedal region to which the damper pedal PD1 is moved for imparting a half pedal effect in the automatic playing.

Although a recording system forms a part of the automatic playing piano, description on the recording system is omitted for the sake of simplicity.

The grand piano 30 includes a keyboard 31 having black keys 31*a* and white keys 31*b*, hammers 32, action units 33, strings 34, dampers 36, a pedal system 71 and a piano cabinet 72. An inner space is defined in the piano cabinet 72, and the action units 33, hammers 32, dampers 36 and strings 34 occupy the inner space. A key bed 72*a* forms a part of the piano cabinet 72, and the keyboard 31 is mounted on the key bed 72*a*.

The black keys 31*a* and white keys 31*b* are laid on the well-known pattern, and extend in parallel to the fore-and-aft direction. Pitch names are respectively assigned to the black keys 31*a* and white keys 31*b*. Balance key pins 31*c* offer fulcrums to the black keys 31*a* and white keys 31*b* on a balance rail 31*d*. Capstan buttons 31*e* are upright on the rear portions of the black keys 31*a* and the rear portions of the white keys 31*b*, and are held in contact with the action units 33. Thus, the black keys 31*a* and white keys 31*b* are respectively linked with the action units 33 so as to actuate the action units 33 during travels of keys 31*a*/31*b* from rest positions toward end positions.

While the weight of action units 33 are being exerted on the rear portions of black keys 31*a* and the rear portions of which keys 31*b* without another sort of force, the black keys 31*a* and white keys 31*b* stay at the rest positions, respectively. While a human player is depressing the front portions of black keys 31*a* and the front portions of white keys 31*b*, the front portions are sunk, and the black keys 31*a* and white keys 31*b* travel from the rest positions to the end positions.

The action units 33 are provided in association with the hammers 3. The actuated action units 33 make human players feel the unique piano key touch, and give rise to rotation of the associated hammers 32.

The strings 34 are stretched over the array of hammers 32 and a sound board 28, and the hammers 3 are respectively opposed to the strings 34. The dampers 36 are spaced from and brought into contact with the strings 34 depending upon the key position. While the black keys 31*a* and white keys 31*b* are staying at the rest positions, the dampers 36 are held in contact with the strings 34, and the weight of dampers 36 is born by the strings 34. Namely, the dampers 36 are found at the restricting region.

When the black keys 31*a* and white keys 31*b* reach certain points on the way toward the end positions, the dampers 36 start to leave the strings 34. While the weight of dampers 36 is being left on the strings, the dampers 36 are held in contact with the strings 34, and are found in the half pedal region. When the weight of dampers 36 is perfectly removed from the strings, the dampers 36 are spaced from the strings 4, and enter the damper free region. As a result, the dampers 36 permit the strings 34 to vibrate. After entry into the damper free region, the action units 33 give rise to the rotation of hammers 32. The hammers 32 are brought into collision with the associated strings 34 at the end of the rotation, and rebound on the strings 34. Thus, the hammers 32 give rise to vibrations of the associated strings 34, and the vibrations are transmitted from the strings 34 to the sound board 28. The acoustic piano tones are produced through the vibrations of the strings 34 at the pitch names identical with those assigned to the associated black and white keys 31*a*/31*b*.

When the human player releases the black keys 31*a* and white keys 31*b*, the black keys 31*a* and white keys 31*a* start to return toward the rest positions. The dampers 39 are getting closer and closer to the associated strings 34, and are brought into contact with the vibrating strings 34 on the way of keys 31*a*/31*b* toward the rest positions. The dampers 36 prohibit the strings 34 from the vibrations. As a result, the acoustic piano tones are decayed.

The pedal system 71 includes three pedals PD1, PD2 and PD3 and three link works 71*a*, 71*b* and 71*c*. The pedals PD1, PD2 and PD3 are called as a "damper pedal", a "sostenuto pedal" and a "soft pedal", respectively, and the link works 71*a*, 71*b* and 71*c* are connected between the pedals PD1, PD2 and PD3 and the lifting rail, a sostenuto rod and a key frame, respectively. When the damper pedal PD1 is depressed to the end position, the acoustic piano tones are prolonged. The sostenuto pedal PD2 is used for independently prolonging the acoustic piano tones, and the soft pedal PD3 is depressed in order to reduce the loudness of the acoustic piano tones.

The automatic playing system 10 includes solenoid-operated key actuators 20 with built-in plunger position sensors 20*a*, solenoid-operated pedal actuators 26 with built-in plunger position sensors 27, a piano controller 40, a motion controller 41 and a servo controller 42. The piano controller 40, motion controller 41 and servo controller 42 stand for functions of a controlling unit 10*a*, and the functions are realized through execution of subroutine programs of a computer program.

A slot 72*b* is formed in the key bed 72*a* below the rear portions of the black and white keys 31*a* and 31*b*, and extends in the lateral direction. The solenoid-operated key actuators 20 are arrayed inside the slot 72*b*, and each of the solenoid-operated key actuators 20 has a plunger 20*b* and a solenoid 20*c*.

The solenoids 20*c* are connected in parallel to the servo controller 42, and are selectively energized with driving signal uk(t) so as to create respective magnetic fields. The plungers 20*b* are provided in the magnetic fields so that the magnetic force is exerted on the plungers 20*b*. The magnetic force causes the plungers 20*b* to project in the upward direction, and the rear portions of the black and white keys 31*a* and 31*b* are pushed with the plungers 20*b* of the associated solenoid-operated key actuators 20. As a result, the black and white keys 31*a* and 31*b* pitch up and down without any fingering of a human player. The servo controller 42 varies the amount of mean current of the driving signal uk(t) so as to control the magnetic force. In this instance, the driving signals uk(t) is supplied to the solenoids 20*c* as a pulse train, and the duty ratio is varied in order to control the magnetic force. In other words, the driving signal uk(t) is a pulse width modulation signal.

The built-in plunger position sensors 20*a* respectively monitor the plungers 20*b*, and supply plunger position signals yk representative of current plunger position to the servo controller 42. The black keys 31*a* and white keys 31*b* are moved together with the plungers 20*b* so that the current plunger positions are equivalent to current key positions. Thus, the built-in plunger position sensors 20*a* indirectly monitor the black keys 31*a* and white keys 31*b*.

The solenoid-operated pedal actuators 26 are provided in association with the damper pedal PD1, sostenuto pedal PD2 and soft pedal PD3, respectively, and move the pedals PD1, PD2, PD3 without any step-on of a human player. Solenoids 26*a* of the pedal actuators 26 are connected in parallel to the servo controller 42, and driving signals up(t) are selectively supplied to the solenoid-operated pedal actuators 26. The driving signals up(t) create magnetic fields around plungers 26*b* of the solenoid-operated pedal actuators 26, and the pedals PD1, PD2 and PD3 are pushed down with the plungers 26*b*. The pedal stroke is depending upon the strength of magnetic fields so that the serve controller 42 controls the pedal stroke by varying the amount of mean current of the driving signals up(t). The built-in plunger position sensors 27 monitor the plungers 26*b*, and supply plunger position signals yp to the servo controller 42. In this instance, the servo controller 42 varies the duty ratio of the driving signal up(t) so as to control the pedal stroke. In other words, the driving signal up(t) is a pulse width modulation signal.

A performance is expressed by pieces of music data, and the pieces of music data are given to the piano controller 40 in the form of music data codes. In this instance, the music data codes are prepared in accordance with the MIDI (Musical Instrument Digital Interface) protocols.

The piano controller 40 is communicable with a data storage where a music data file is stored. In the automatic playing, the piano controller 40 periodically searches the music data file for a music data code to be presently processed. When the piano controller 40 finds the music data code or codes to be presently processed, the piano controller 40 supplies the music data code or codes to the motion controller 41.

The motion controller 41 determines a series of values of target key position rk and a series of values of target pedal position rp. The target key position rk and target pedal position rp are varied with time. The target key position rk and target pedal position rp are timely supplied from the motion controller 41 to the servo controller 42.

The servo controller 42 compares the target key position rk and target pedal rp with the current key position yk and current pedal position yp, which are respectively supplied from the built-in plunger position sensor 20*a* and built-in plunger position sensor 27, and determines the amount of means current or duty ratio of the driving signal uk(t) and the amount of mean current or duty ratio of the driving signal up(t) through the comparison. If the current key positions yk and current pedal position yp are found to be at the back of the target key position uk(t) and target pedal position up(t), the servo controller 42 increases the duty ratio of the driving signals uk(t) and up(t) so that the black keys 31*a* , white keys 31*b* and pedals PD1, PD2 and PD3 are accelerated. On the other hand, if the current key positions yk and current pedal position yp are found to be in front of the target key position uk(t) and target pedal position up(t), the servo controller 42 decreases the duty ratio of the driving signals uk(t) and up(t) so that the black keys 31*a*, white keys 31*b* and pedals PD1, PD2 and PD3 are decelerated. Thus, the servo controller 42 accelerates and decelerates the black keys 31*a* , white keys 31*b* and pedals PD1, PD2 and PD3 so as to force the black keys 31*a*, white keys 31*b* and pedals PD1, PD2 and PD3 to trace the series of values of target key position and series of values of target pedal position.

The pedal testing system 60 includes the servo controller 42, motion controller 41, piano controller 40 and a vibration sensor 51. Thus, the servo controller 42, motion controller 41 and piano controller 40 are shared between the automatic playing system 10 and the pedal testing system 60. The vibration sensor 51, piano controller 40, motion controller 41 and servo controller 42 cooperate with the vibration sensor 51, and determine the half pedal point in the half pedal region through an experiment.

The vibration sensor 51 converts the vibrations of strings 34 to a detecting signal ys indicative of the strength of vibrations. In this instance, the vibration sensor 51 is implemented by a combination of a piezoelectric element 51*a* on the sound board 28, a microphone 52 over the sound board 28 and three electromagnetic pickup units 53 in the vicinity of predetermined strings 34. In this instance, the predetermined strings 34 are selected from the lower pitched part, middle pitched part and higher pitched part, respectively. The vibration sensor 51 outputs the detecting signal ys, and the detecting signal ys is supplied to the servo controller 42. In this instance, the three sorts of vibration-to-electric signal converters 51*a*, 52 and 53 produce analog signals, and the detecting signal ys stands for these analog signals. The analog detecting signal ys is converted to a digital detecting signal ys before a data processing as will be described in conjunction with the system configuration of the controlling unit 10*a*.

Turning back to FIG. 1, an array of key position sensors 37*a* is provided below the front portions of the black and white keys 31*a*/31*b*, and monitors the black and white keys 31*a*/31*b*, respectively. An array of hammer position sensors 37*b* is provided over the hammers 32, and monitors the hammers 32. The key position sensors 37*a* and hammer position sensors 37*b* form parts of the recording system, and a performance on the grand piano 30 is recorded through the recording system.

A hammer stopper 80 is provided over the array of hammers 32, and an electric motor 81 is connected to the hammer stopper 80. The hammer stopper 80 extends in the lateral direction, and is changed between a free position and a blocking position. While the hammer stopper 80 is staying at the free position, the hammers 32 are brought into collision with the strings 34 without any interruption of the hammer stopper 80, and rebound on the strings 34. When the electric motor 81 rotates the hammer stopper 80 from the free position to the blocking position, the hammer stopper 80 enters the orbits of hammers. In this situation, the hammers 32 rebound on the hammer stopper 80 without any strike at the strings 34, and any acoustic piano tone is not produced. Though not shown in FIG. 1, an electronic tone generator and effectors are incorporated in the controlling unit 10*a*, and produce music data codes on the basis of the signals supplied from the key position sensors 37*a* and hammer position sensors 37*b*. The music data codes are finally converted to electronic tones through speakers of a sound system.

Figure 3:
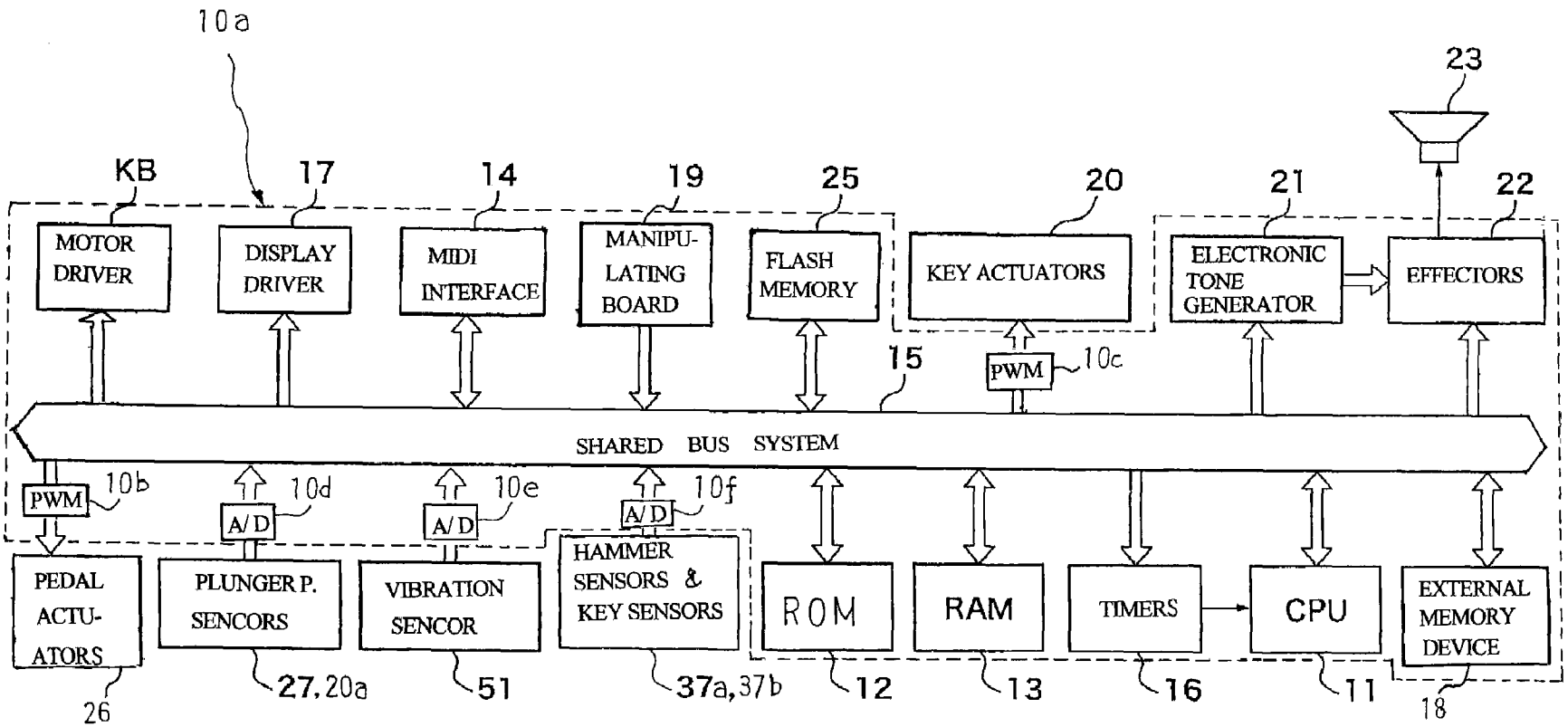
FIG. 3 is a block diagram showing the system configuration of a controlling unit.

FIG. 3 shows the system configuration of the controlling unit 10*a*. The controlling unit 10*a* includes pulse width modulators 10*b*/10*c*, analog-to-digital converters 10*d*/10*e*/10*f*, a central processing unit 11, which is abbreviated as "CPU", a read only memory 12, which is abbreviated as "ROM", a random access memory 13, which is abbreviated as "RAM", an MIDI interface 14, a shared bus system 15, timers 16, a display driver 17, an external memory device 18, a manipulating board 19, an electronic tone generator 21, effectors 22 and a flash memory 25. The central processing unit 11 is connected to the shared bus system 15, and is communicable with the other system components 10*b*, 10*c*, 10*d*, 10*e*, 10*f*, 12, 13, 14, 16, 17, 18, 19, 21 and 22 through the shared bus system 15.

The central processing unit 11 is an origin of the information processing capability of the controlling unit 10*a*, and accomplishes given tasks through execution of instruction codes.

The instruction codes are stored in the read only memory 12 together with pieces of test data, pieces of image data and other control parameters in the non-volatile manner, and form a computer program. The computer program expresses the tasks, and runs on the central processing unit 11. The computer program is hereinlater described in detail.

The random access memory 13 and extended memory 19 offer a temporary data storage to the information processor 10, and flags are defined in predetermined memory locations. For example, the pieces of test data and pieces of music data are, by way of example, stored in the temporary data storage in the random access memory 22, and pieces of experimental data are accumulated in the random access memory 13 during the execution of a subroutine program for the half pedal region.

The MIDI interface 14 is provided for communication with another musical instrument designated on the MIDI protocols. Music data codes may be supplied through the MIDI interface 14 between the musical instrument and the controlling unit 10*a*.

The timers 16 independently measure the lapse of time. One of the timers 16 is assigned to measurement of a time period between a note-on/note-off event and the previous note-on/previous note-off event. Another timer 16 gives timings for timer interruptions.

The display driver 17 is connected to a panel display unit (not shown) such as a liquid crystal display panel, and produces an image or images on the panel display unit. Current status of the automatic player piano and prompt messages are delivered to users through the panel display unit. An image of a music score is produced on the panel display unit on the basis of the pieces of image data under the control of the central processing unit 11.

The external memory device 18 has a huge data holding capability in the non-volatile manner. A flexible disk driver and flexible disks, or a compact disk driver and compact disks serve as the external memory 18. Music data files may be transferred from the external memory device 18 to the random access memory 13 before the automatic playing.

Various switches are provided on the manipulating board 19. One of the switches is a power switch, and a user activates the controlling unit 10*a* by turning on the power switch. Users give their instructions to the controlling unit 10*a* through the manipulating board 19. A user changes the automatic player piano among the automatic playing, mute playing, test and so forth through some switches, and selects a tune to be played from a list of music data files.

The electronic tone generator 21 includes a waveform memory, plural read-out circuits and a key assigner, and cooperates with effectors 22. The key assigner assigns the note-on events, which the music data codes express, to the read-out circuits, and the read-out circuits make pieces of waveform data read out from the waveform memory. A digital audio signal is produced from the pieces of waveform data. Certain music data codes stand for the effects of the pedals PD1, PD2 and PD3, and the digital audio signal is modified through the effectors 22 in the presence of the certain data codes. The music data codes are produced through the fingering on the keyboard 31, or are supplied from the outside of the mute piano.

The effectors 22 vary the electronic tones depending upon the current pedal positions of the pedals PD1, PD2 and PD3. While the damper pedal PD1 is, by way of example, staying at the restricting region, any effect is not given to the electronic tones. The effectors 22 give the half-pedal effect, through which the tones are reduced in loudness, to the electronic tones in the half pedal region, and give a damper effect, through which the tones are prolonged, to the electronic tones in the damper-free position.

The electronic tone generator 21 is connected to the sound system 23 directly or through the effectors 22. The sound system 23 includes a digital-to-analog converter, a preliminary amplifier, a main amplifier and loud-speakers, in which a headphone speaker is included. The digital audio signal is converted to an analog audio signal, and the electronic tones are radiated from the loud speakers of the sound system 23.

The flash memory 25 has a large data holding capability, and music data files are stored in the flash memory 25 in the non-volatile manner.

The pulse width modulators 10*b* and 10*c* are respectively provided for the solenoid-operated pedal actuators 26 and solenoid-operated key actuators 20. Pieces of control data expressing the target duty ratio are supplied from the central processing unit 11 to the pulse width modulators 10*b* and 10*c*. Then, the pulse width, modulators 10*b* and 10*c* adjust the driving signals uk(t) and up(t) to the target duty ratio, and supply the driving signals uk(t) and up(t) to the solenoids 20*c* of solenoid-operated key actuators 20 and the solenoids 26*a* of solenoid-operated pedal actuators 26 so as to give rise to the movements of specified keys 31*a*/31*b* and the movements of specified pedals PD1, PD2 and PD3.

The analog-to-digital converters 10*d*, 10*e* and 10*f* are connected between the plunger position sensors 27/20*a*, vibration sensors 51 and hammer sensors/key sensors 37*a*/37*b* and the shared bus system 15. The analog plunger position signals yk/yp, analog detecting signal ys, analog key position signals and hammer position signals are periodically sampled and converted to digital plunger position signals, digital detecting signal ys, digital key position signals and digital hammer position signals. These digital signals are hereafter labeled with the reference same as those designating the corresponding analog signals. Since data buffers are incorporated in the analog-to-digital converters 10*d*, 10*e* and 10*f*, the central processing unit 11 periodically fetches the digital signals from the data buffers, and stores the pieces of plunger position data, pieces of loudness data represented by the detecting signal ys, pieces of key position data and pieces of hammer position data in the random access memory 13.

Subsequently, description is made on the computer program. The computer program is broken down into a main routine program and subroutine programs. While the main routine program is running on the central processing unit 11, users can communicate with the central processing unit 11 through the manipulating board 19. The main routine program periodically branches to the subroutine programs.

The central processing unit 11 periodically fetches the pieces of pedal position data expressing the current pedal position, pieces of loudness data expressing the loudness of acoustic piano tones, pieces of key position data expressing the current key positions and pieces of hammer position data expressing the current hammer positions through the execution on one of the subroutine programs, and stores them in the random access memory 13.

Another of the subroutine program is assigned to the automatic playing. When a user instructs the automatic playing system 10 to perform a tune on the grand piano 30, the central processing unit raises a flag indicative of the automatic playing. Upon entry into the subroutine program for the automatic playing, the central processing unit 11 checks the flag to see whether or not the user has instructed the automatic playing to the automatic playing system 10. If the answer is given negative, the central processing unit 11 immediately returns to the main routine program. On the other hand, if the answer is given affirmative, the piano controller 40, motion controller 41 and servo controller 42 are realized through the execution of the remaining instruction codes of the subroutine program for the automatic playing.

The half pedal point is determined through execution of another subroutine program, which is hereinafter described in detail. Since the pedal stroke to enter the half pedal region is not constant among the acoustic pianos, the testing system 60 determines the half pedal point through an experiment on the grand piano 30. When a tuner, a worker or a user requests the testing system 60 to determine the half pedal point through the manipulating board 19, the central processing unit 11 raises the flag indicative of the test, and starts periodically to enter the subroutine program for the half pedal point.

Figure 4:
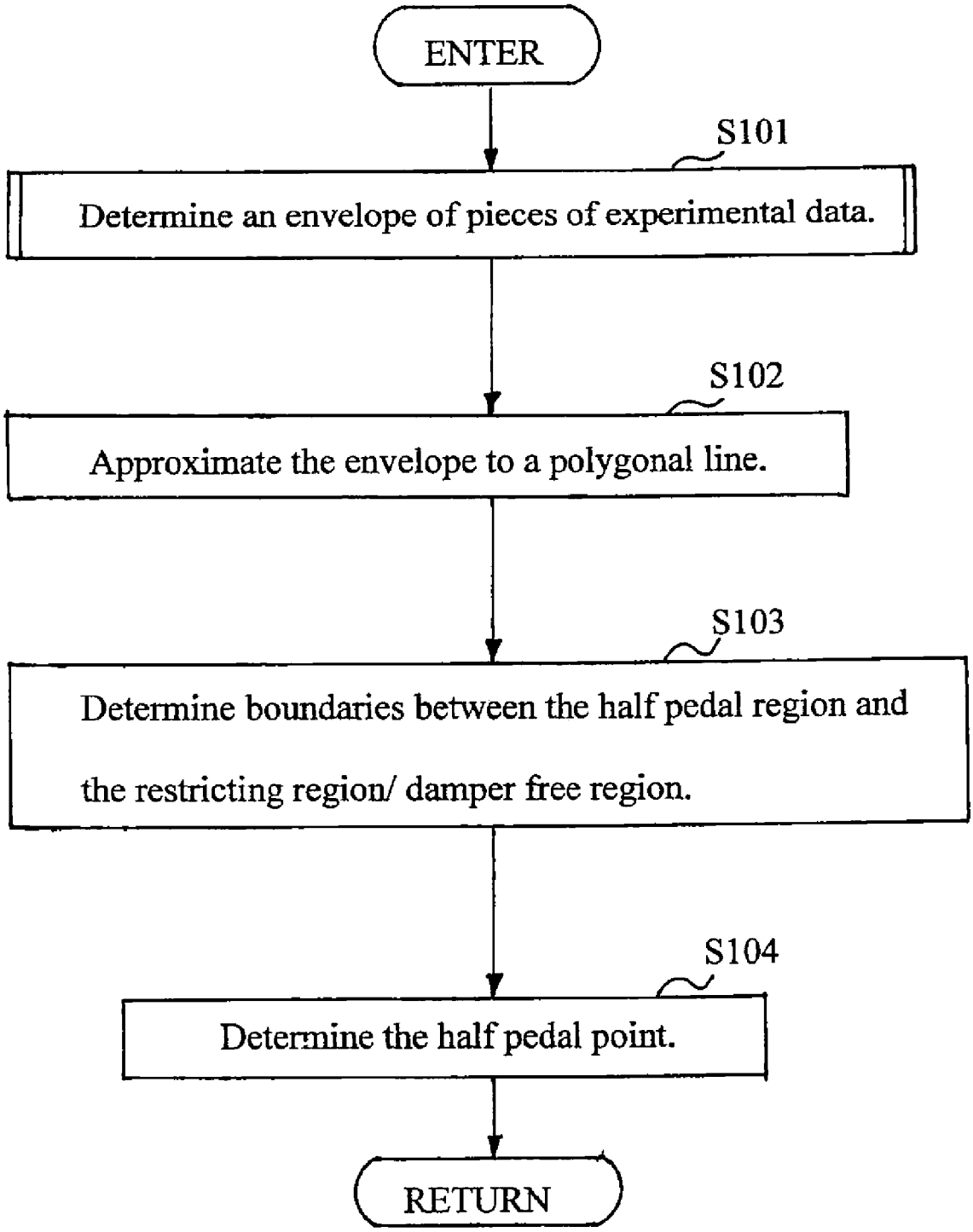
FIG. 4 is a flowchart showing a job sequence of a subroutine program for a half pedal point.

FIG. 4 shows the job sequence of the subroutine program for the half pedal point. A worker is assumed to instruct the testing system 60 to determine the half pedal point through the manipulating board 19. The central processing unit 11 acknowledges the instruction, and raises the flag indicative of the determination of half pedal point. When the main routine program branches to the subroutine program, the central processing unit 11 proceeds to the job sequence shown in FIG. 4.

The central processing unit 11 makes the pulse width modulator 10*c* to drive a black key 31*a* or a white key 31*b* by means of the associated solenoid-operated key actuator 20 for producing an acoustic piano tone through the strike at the string 34. Thereafter, the central processing unit 11 makes the pulse width modulator 10*b* to drive the damper pedal PD1 for a travel from the end position to the rest position by means of the associated solenoid-operated pedal actuator 26, and starts the timer to measure the lapse of time.

Figure 5A:
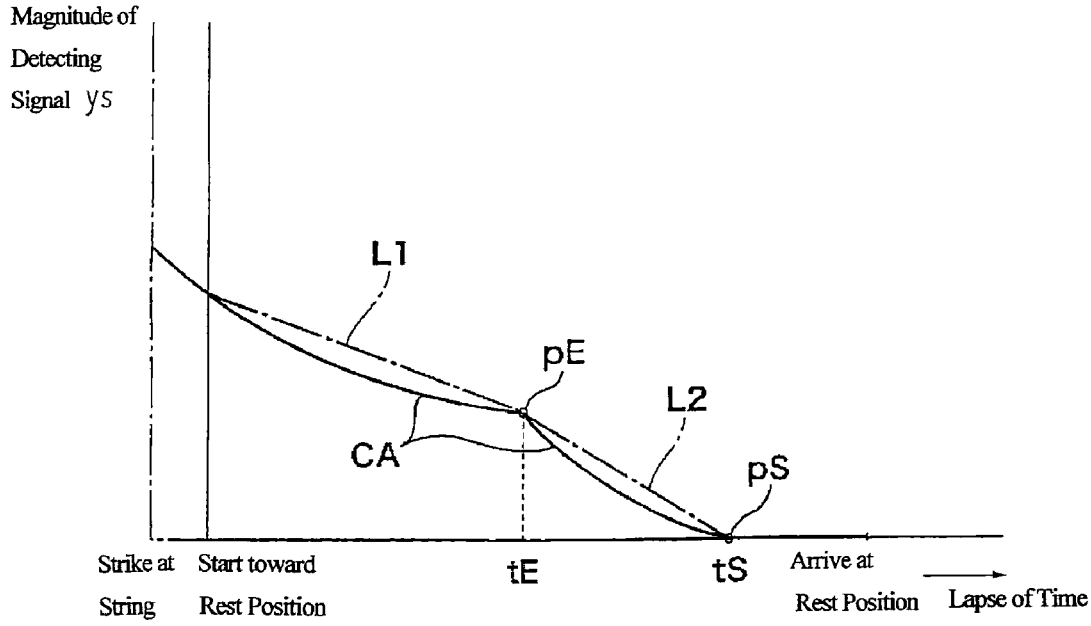
FIG. 5A is a diagram showing an envelope of plots expressing waveform of acoustic piano tones and a polygonal line to which the envelope is approximated.

The central processing unit 11 periodically fetches the digital detecting signal ys expressing the loudness of the acoustic piano tone and the output signal of the timer expressing the lapse of time, and accumulate the pieces of loudness data and pieces of time data as pieces of experimental data. The central processing unit 11 determines an envelope CA of plots expressing the peaks of the waveform expressing the acoustic piano tones as by step S101. Pieces of envelope data express the envelope of plots CA, and the envelope CA is shown in FIG. 5A. In order to accumulate the pieces of experimental data, the damper pedal PD1 is moved in uniform motion from the end position to the rest position so that the pedal position or pedal stroke is varied as indicated by plots CB in FIG. 5B.

In order to move the damper pedal PD1 in uniform motion, the piano controller 40 reads out the pieces of test data expressing a reference pedal trajectory from the read only memory 12, and transfers the pieces of test data to the motion controller 41. The reference pedal trajectory is a series of values of target pedal position varied with time. The damper pedal PD1 is moved on the reference pedal trajectory at high speed. The pedal velocity is large enough to make the damper pedal PD1 brought into contact with the vibrating strings 34 for restricting the vibrations. In this instance, the time period from the initiation of pedal movement to the contact with the vibrating strings 34 is of the order of 2.5 seconds.

The motion controller 41 reads out the present time from the timer 16, and determines a value of target pedal position rp at the present time. The value of target pedal position rp is supplied from the motion controller 41 to the servo controller 42.

The servo controller 42 fetches the piece of plunger position data expressing the current plunger position and current pedal position yp from the data buffer of the analog-to-digital converter 10*d*, and compares the target pedal position rp with the current pedal position yp to see whether or not a stroke difference ep is found between the target pedal position rp and the current pedal position yp. If the current pedal position yp is consistent with the target pedal position rp, the servo controller 42 keeps the duty ratio of the driving signal up(t). When the stroke difference ep is found between the current pedal position yp and the target pedal position rp, the servo controller 42 determines a target duty ratio up through an amplification of the stroke difference ep. The target duty ratio up is determined in order to minimize the stroke difference ep.

The pulse width modulator 10*b* adjusts the driving signal up(t) to the target duty ratio, and supplies the driving signal up(t) to the solenoid 26*a*. The above-described control loop is repeated during the travel of the damper pedal PD1 so as to force the damper pedal PD1 to travel on the reference pedal trajectory.

Figure 7A:
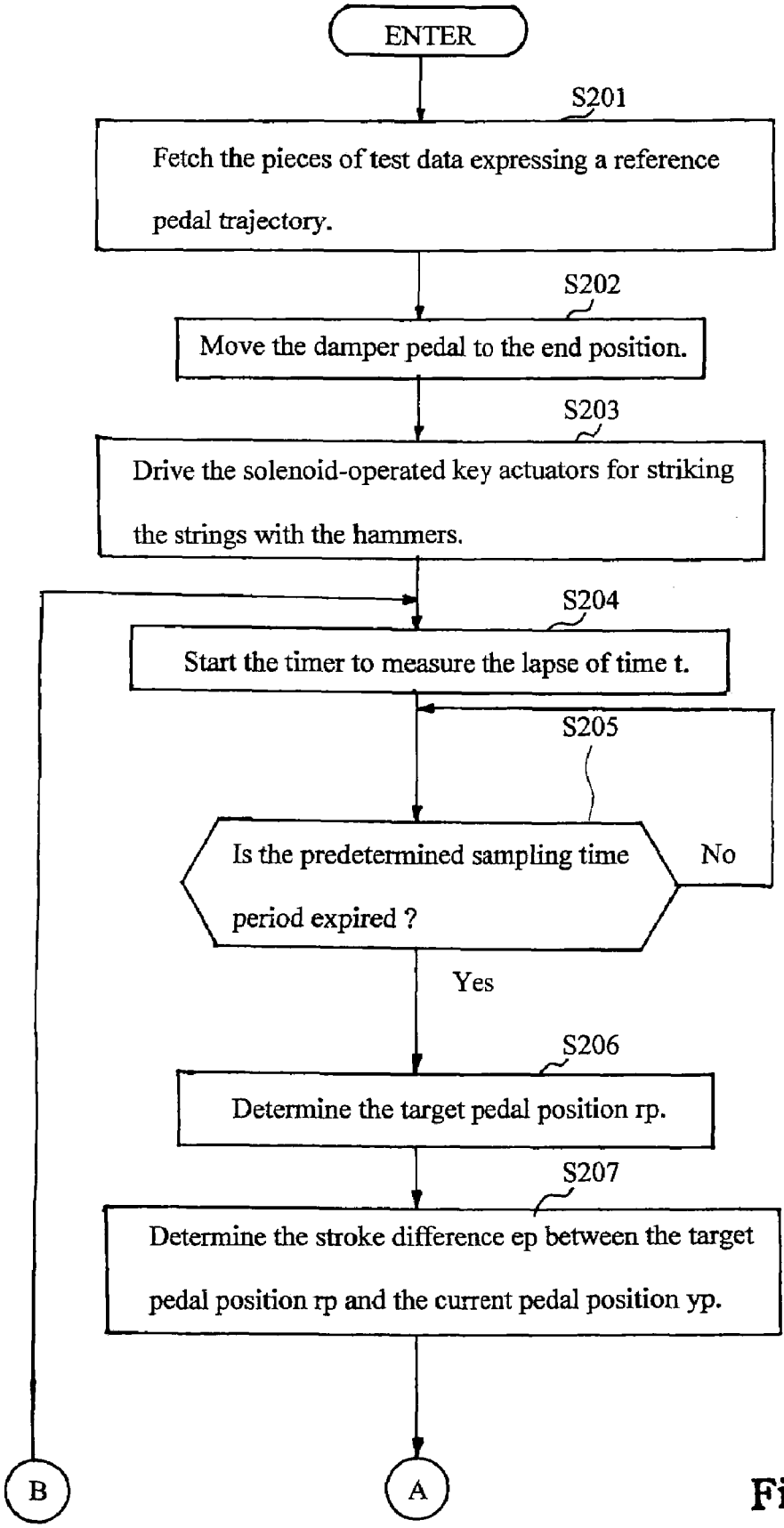
FIGS. 7A and 7B are flowcharts showing a job sequence for determining the envelope of the waveform of acoustic piano tones.
Figure 7B:
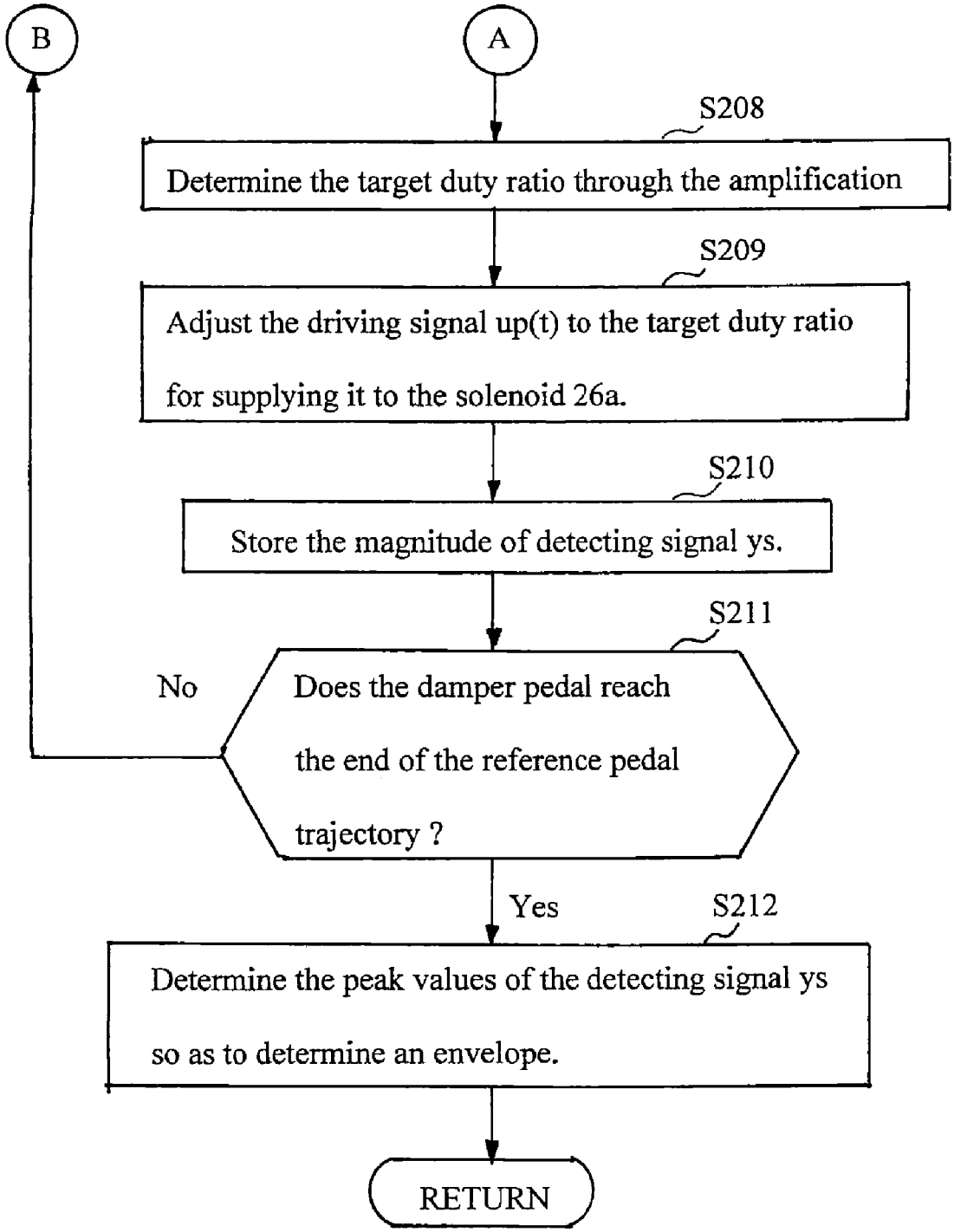

The jobs at step S101 is illustrated in more detail in FIG. 7. The central processing unit 11 fetches the pieces of test data from the read only memory 12 as by step S201. The pieces of test data express a reference pedal trajectory.

The central processing unit 11 supplies a piece of control data expressing the movement of the damper pedal PD1 to the end position to the pulse width modulator 10*b*, and the pulse width modulator 10*b* supplies the driving signal up(t) to the solenoid-operated pedal actuator 27 associated with the damper pedal PD1. Then, the solenoid-operated pedal actuator 26 downwardly projects the plunger 26*b*, and the damper pedal PD1 is moved to the end position as by step S202.

Subsequently, the central processing unit 11 supplies pieces of control data expressing the movement of predetermined keys 31*a*/31*b* to the end positions to the pulse width modulator 10*c*. The pulse width modulator 10*c* supplies the driving signals uk(t) to the solenoid-operated key actuators 20 associated with the predetermined keys 31*a*/31*b*. The driving signals uk(t) make the plungers 20*b* upwardly project from the solenoids 20*c* so that the predetermined keys 31*a*/31*b* are moved toward the end positions. The associated action units 33 are actuated by the predetermined keys 31*a*/31*b*, and cause the hammers 32 to rotate toward the strings 34. The hammers 32 are brought into collision with the strings 34 at the end of the rotation, and give rise to the vibrations of the strings 34. Thus, the central processing unit 11 makes the pulse width modulator 10*c* drive the solenoid-operated key actuators 20 for striking the strings 34 with the hammers 32 as by step S203. The hammer velocity is large enough to keep the strings 34 vibrating until the dampers 36 take up the vibrations of strings 34.

Three keys 31*a*/31*b* are selected from the lower pitched part, middle pitched part and higher pitched part, respectively, as the predetermined keys 31*a*/31*b*. It is desirable to form the at least three acoustic piano tones a chord.

The central processing unit 11 checks the pieces of pedal position data to see whether or not the damper pedal PD1 starts to return toward the rest position. While the answer is given negative, the central processing unit 11 proceeds to step S206. When the answer is given affirmative, the central processing unit 11 starts the timer 26 in order to measure the lapse of time as by step S204. The central processing unit 11 starts the timer, once. After the initiation of the measurement of the lapse of time, the central processing unit 11 proceeds to step S205 without any execution at step S204.

The central processing unit 11 periodically checks another timer 26 to see whether or not the predetermined sampling time period is expired as by step S205. In this instance, the predetermined time period is 4 millisecond. While the timer 26 is giving the negative answer "No" to the central processing unit 11, the central processing unit 11 waits for the expiry of predetermined sampling time period.

When the predetermined time period is expired, the answer at step S205 is given affirmative "Yes", and the central processing unit 11 fetches the piece of pedal position data expressing the current pedal position yp from the analog-to-digital converter 10*d*. The central processing unit 11 determines the target pedal position rp on the reference pedal trajectory as by step S206.

The central processing unit 11 compares the current pedal position yp and the target pedal position rp so as to determine the stroke difference ep through the calculation as by step S207. The current pedal position yp was stored during the previous execution loop, i.e., from step S204 to step S211.

Subsequently, the central processing unit 11 multiplies the stroke difference ep by a gain, and determines the target duty ratio through the multiplication or amplification as by step S208.

The central processing unit 11 informs the pulse width modulator 10*b* of the target duty ratio. The central processing unit 11 makes the pulse width modulator 10*b* adjust the driving signal up(t) to the target duty ratio, and the driving pulse signal up(t) is supplied to the solenoid-operated pedal actuator 26 as by step S209. The solenoid-operated pedal actuator 26 keeps, accelerates or decelerates the movement of plunger 26*b*.

Subsequently, the central processing unit 11 fetches the piece of loudness data expressing the magnitude of the detecting signal ys from the analog-to-digital converter 10*e*, and stores the piece of loudness data together with the current pedal position and the piece of time data expressing the lapse of time from the initiation of pedal movement in the random access memory 13 as a piece of experimental data as by step S210. The central processing unit 11 resets the timer 26 to zero for measuring the predetermined sampling time period.

The central processing unit 11 checks the pieces of test data to see whether or not the damper pedal PD1 reaches the end of the reference pedal trajectory as by step S211. If the damper pedal PD1 is found to be on the way to the end of reference pedal trajectory, the answer is given negative, and the central processing unit 11 returns to the step S204. Thus, the central processing unit 11 reiterates the loop consisting of steps S204 to S211 until the damper pedal PD1 reaches the end of reference pedal trajectory.

When the damper pedal PD1 reaches the end of reference pedal trajectory, the answer at step S211 is changed to affirmative. Then, the central processing unit 11 searches the random access memory 13 for the pieces of loudness data expressing the peaks of the waveform of the acoustic piano tone or waveform of vibrations, and determines the envelope on which the peak values are found as by step S212.

Thus, the central processing unit 11 accomplishes the jobs at step S101 through the execution at steps S201 to S212.

Turning back to FIGS. 4, 5A and 5B, description is made on the jobs after step S101. When the central processing unit 11 proceeds to step S102, the central processing unit 11 approximates the curve expressing the envelope CA to a polygonal line L1 and L2. The polygonal line L1 and L2 is determined as follows. Adjacent two plots are selected from the envelope CA, and the central processing unit 11 calculates difference between values of the magnitude of detecting signal ys at the adjacent two plots to see whether or not the difference is less than a predetermined critical value. If the answer is given affirmative, a line is drawn between the adjacent two plots. The above-described work is carried out from the initiation of pedal motion toward the rest position and the plot pS at which the magnitude of detecting signal ys is zero. In this instance, the envelope CA is approximated to the two linear lines L1 and L2, which crosses at plot pE.

Subsequently, the central processing unit 11 analyzes the envelope CA, and determines the restricting region, half pedal region and damper free region as by step S103. In detail, the gradient of envelope is minimized at plot pE. This is because of the fact that the dampers 36 are brought into contact with the strings 34 on the way toward the rest position and that the dampers 36 become spaced from the strings 34 on the way toward the end position. Since the magnitude of detecting signal ys is decreased to zero at plot pS. This is because of the fact that the dampers 34 become effective against the vibrations of the strings 34. In other words, when the damper pedal PD1 passes the plot pS, the dampers 36 gradually lose the pressure on the strings 34.

Figure 5B:
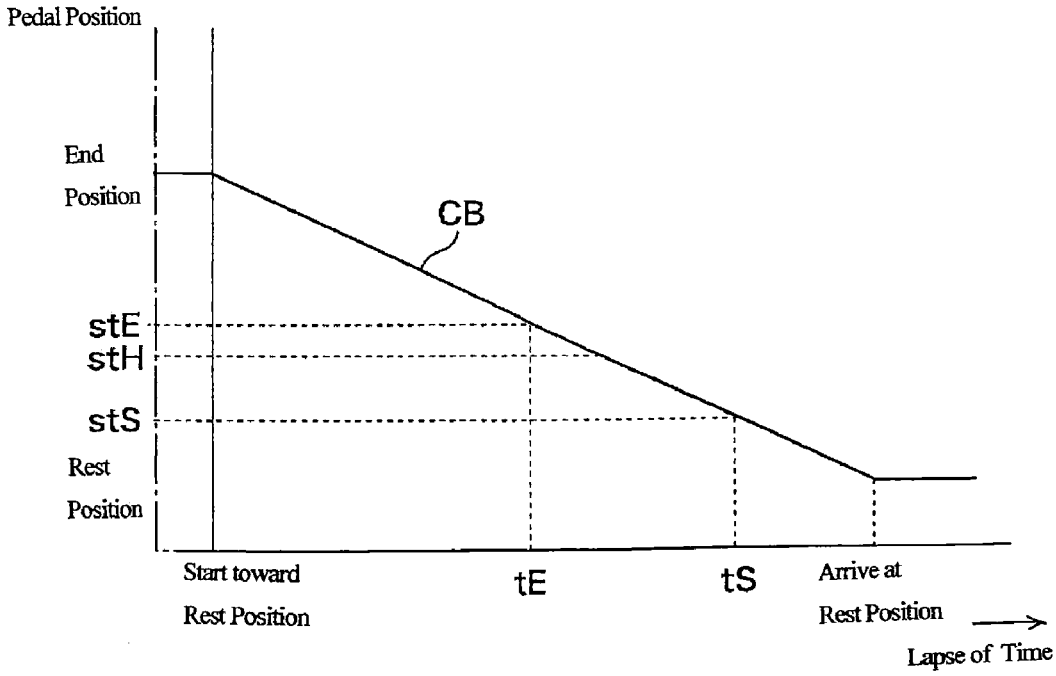
FIG. 5B is a diagram showing the trajectory of a damper pedal during a test.
Figure 6:
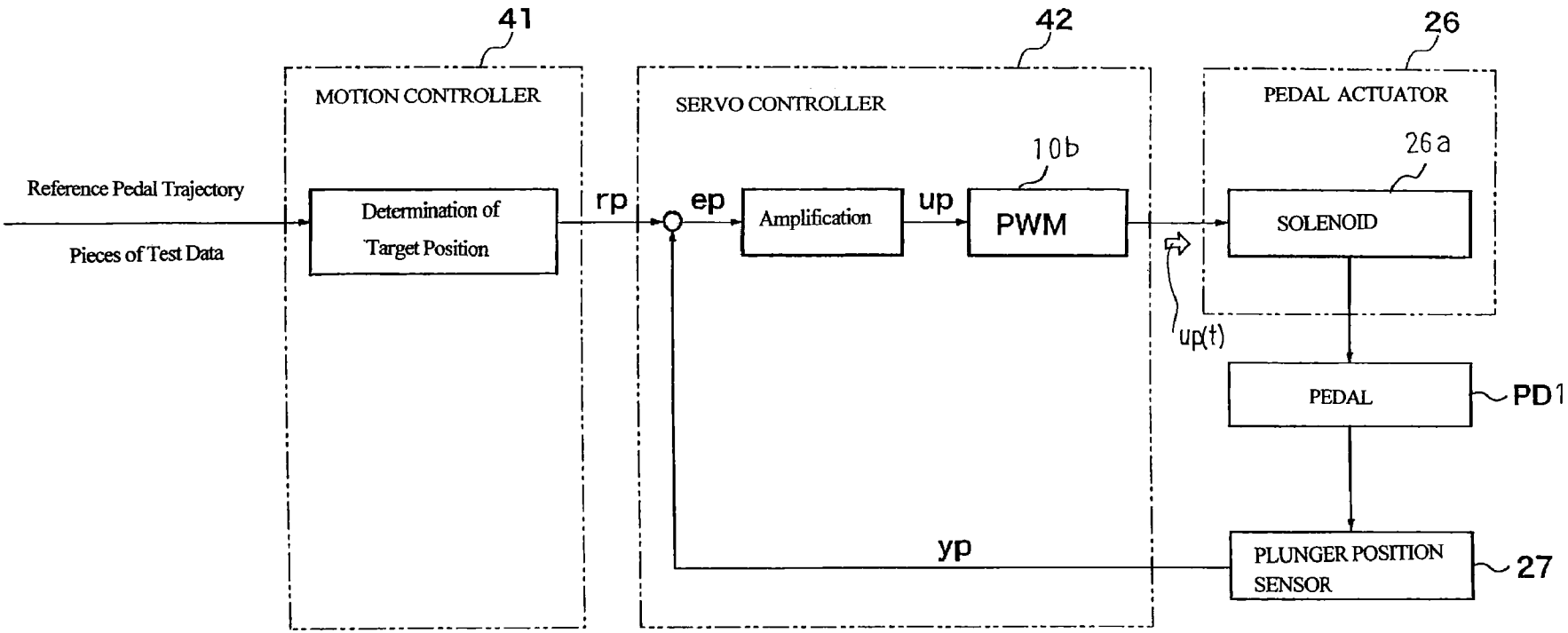
FIG. 6 is a block diagram showing a servo control on the damper pedal in the test.

From the above-described analysis, the boundary between the restricting region and the half pedal region is determined at the pedal stroke stS in FIG. 5B, and the boundary between the half pedal region and the damper free region is determined at the pedal stroke stE. Thus, the pedal trajectory is divided into the three regions, i.e., the restricting region from the rest position at the pedal stroke of zero to the pedal stroke stS, the half pedal region from the pedal stroke stS to the pedal stroke stE and the damper free region from the pedal stroke stE to the end position.

Finally, the central processing unit 11 determines the half pedal point as by step S104. The half pedal point is found at a certain pedal stroke in the half pedal region, and the central processing unit 11 controls the damper pedal PD1 to the half pedal point for imparting the half pedal effect to the acoustic piano tones. In this instance, the central processing unit 11 determines the half pedal point through the internal division. The difference between the pedal stroke stS and the pedal stroke stE is divided at 2:1. The point of internal division at 2:1 is found at the pedal stroke stH. Thus, the half pedal point is determined at the pedal stroke stH. The half pedal point stH is equivalent to the depth of damper pedal at "64" of the MIDI code.

While the automatic playing system 10 is reenacting a performance, the servo controller 42 moves the damper pedal PD1 to the half pedal point stH in response to the music data code expressing the half pedal effect.

As will be understood from the foregoing description, the testing system 60 accumulates the pieces of experimental data expressing the relation between the loudness of acoustic piano tones and the pedal stroke, and determines the boundary between the restricting region and the half pedal region and the boundary between the half pedal region and the damper free region on the basis of the rate of change in the loudness. Even though the array of dampers 36 is inclined in the lateral direction due to the difference in weight of dampers 36, the influences of irregularity is taken into the loudness of acoustic piano tones, and the testing system 60 determines the half pedal region in consideration of the influences of irregularity. Since the pianists and audience recognize the half pedal effect through their ears, the half pedal region thus determined is close to the half pedal region determined by a human tuning worker, and the half pedal point is surely specified in the half pedal region. The automatic playing system controls the damper pedal PD1 to the half pedal point stH in the half pedal region so that the half pedal effect is surely reproduced in the automatic playing.

Second Embodiment

Another testing system implementing the second embodiment is same as the testing system 60 of the automatic playing piano implementing the first embodiment except for jobs at steps S102, S103 and S104. The testing system implementing the second embodiment is also incorporated in an automatic playing system, and, for this reason, component parts of the automatic playing system are accompanied with the references designating the corresponding component parts of the automatic playing piano implementing the first embodiment without detailed description.

Figure 8:
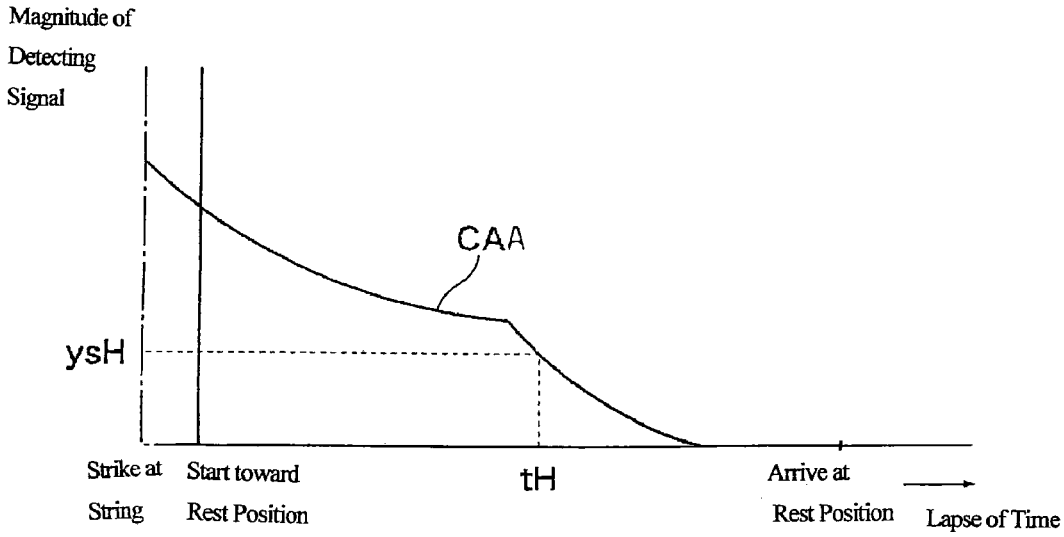
FIG. 8 is a diagram showing an envelope of plots expressing waveform of acoustic piano tones.

FIG. 8 shows an envelope CAA of plots expressing the waveform of acoustic piano tones produced through the vibrations of the strings 34. In this instance, the central processing unit 11 determines a half pedal point stHA at a predetermined value ysH of the magnitude of detecting signal ys.

The central processing unit 11 searches the pieces of envelope data expressing an envelope CAA for a value of the magnitude of detecting signal ys closest to the predetermined value ysH. When the central processing unit 11 finds the value closest to the predetermined value ysH, the central processing unit 11 determines the time tH at which the value ysH is produced, and reads out the pedal stroke stH at the time tH. The central processing unit 11 determines the half pedal point at the pedal stroke stH.

The predetermined value ysH is determined by the manufacturer through the experiment on a grand piano same in model as the grand piano 30, and is stored in the read only memory 12 or flash memory 25. The black and white keys 31*a*/31*b* are driven for travel at the key velocity equal to that in the experiment. For this reason, the central processing unit 11 can find the pedal stroke before the decay of acoustic piano tones. In case where the magnitude of detecting signal ys does not reach the value ysH within a predetermined time period, the central processing unit 11 stops the experiment, and carries out the experiment at the key velocity less than the previous key velocity.

The automatic playing piano implementing the second embodiment achieves all the advantages of the first embodiment. Moreover, the experiment for the second embodiment is simpler than that for the first embodiment.

Third Embodiment

Yet another testing system implementing the third embodiment is same as the testing system 60 of the automatic playing piano implementing the first embodiment except for preparation of experimental data. The testing system implementing the third embodiment is incorporated in an automatic playing system, and, for this reason, component parts of the automatic playing system are accompanied with the references designating the corresponding component parts of the automatic playing piano implementing the first embodiment without detailed description.

Figure 9:
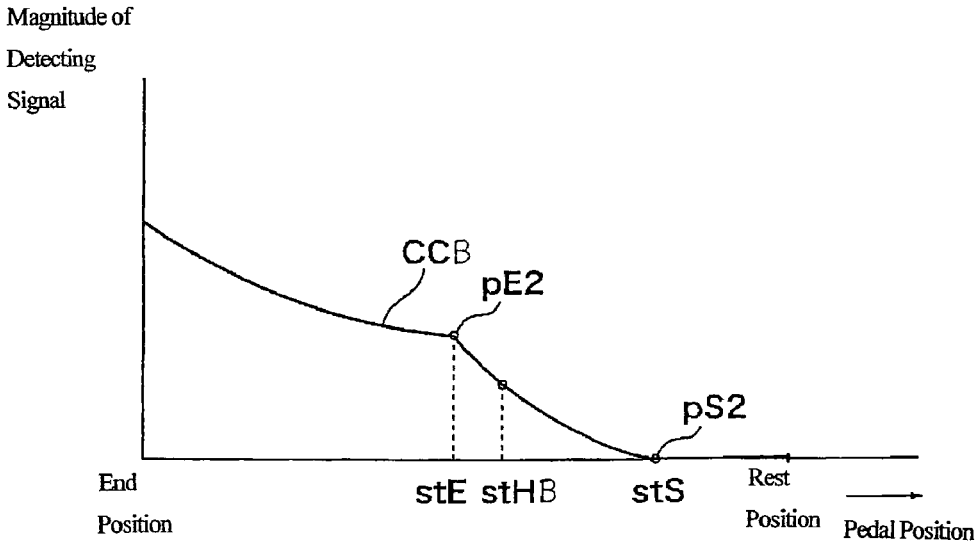
FIG. 9 is a diagram showing an envelope of plots expressing waveform of acoustic piano tones.

FIG. 9 shows an envelope CC of plots expressing the waveform of acoustic piano tones produced through the vibrations of the strings 34. The central processing unit 11 correlates the magnitude of detecting signal ys with the pedal position or pedal stroke, and analyzes plots CCB in order to determines the half pedal position stH. In this instance, the central processing unit 11 determines a half pedal point through the following data processing instead of the jobs at steps S210 and S212.

In the test, the central processing unit 11 pairs the pieces of loudness data expressing the magnitude of detecting signal ys with the pieces of pedal position data expressing the current pedal position. The pairs of pieces of loudness data and pieces of pedal position data are expressed by plots CCB as pieces of experimental data. The plots CCB is close to the plots CA. The plots CCB has a point of inflection pE2 and a plot pS2 at which the magnitude of detecting signal is deceased to zero. The point of inflection pE2 and plot pS are determined as similar to pE and pS. The plots pE2 and pS2 express the pedal stroke stE and stS. The half pedal point stHB is determined on the line expressing the stroke difference between stE and stS through the internal division.

The testing system implementing the third embodiment achieves all the advantages of the first embodiment. Moreover, the method for specifying the half pedal point stHB is simpler than that of the first embodiment.

Fourth Embodiment

Still another testing system implementing the fourth embodiment is same as the testing system 60 of the automatic playing piano implementing the first embodiment except for a method of determination of a half pedal point. The testing system implementing the fourth embodiment is incorporated in an automatic playing system, and, for this reason, component parts of the automatic playing system are accompanied with the references designating the corresponding component parts of the automatic playing piano implementing the first embodiment without detailed description.

Figure 10:
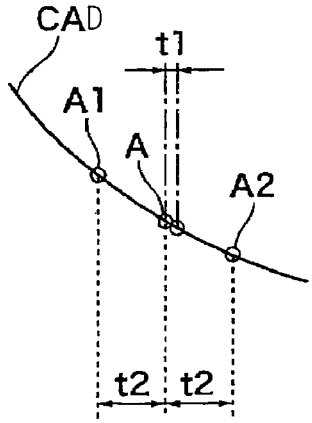
FIG. 10 is a view illustrating a method for determining a half pedal point.
Figure 11:
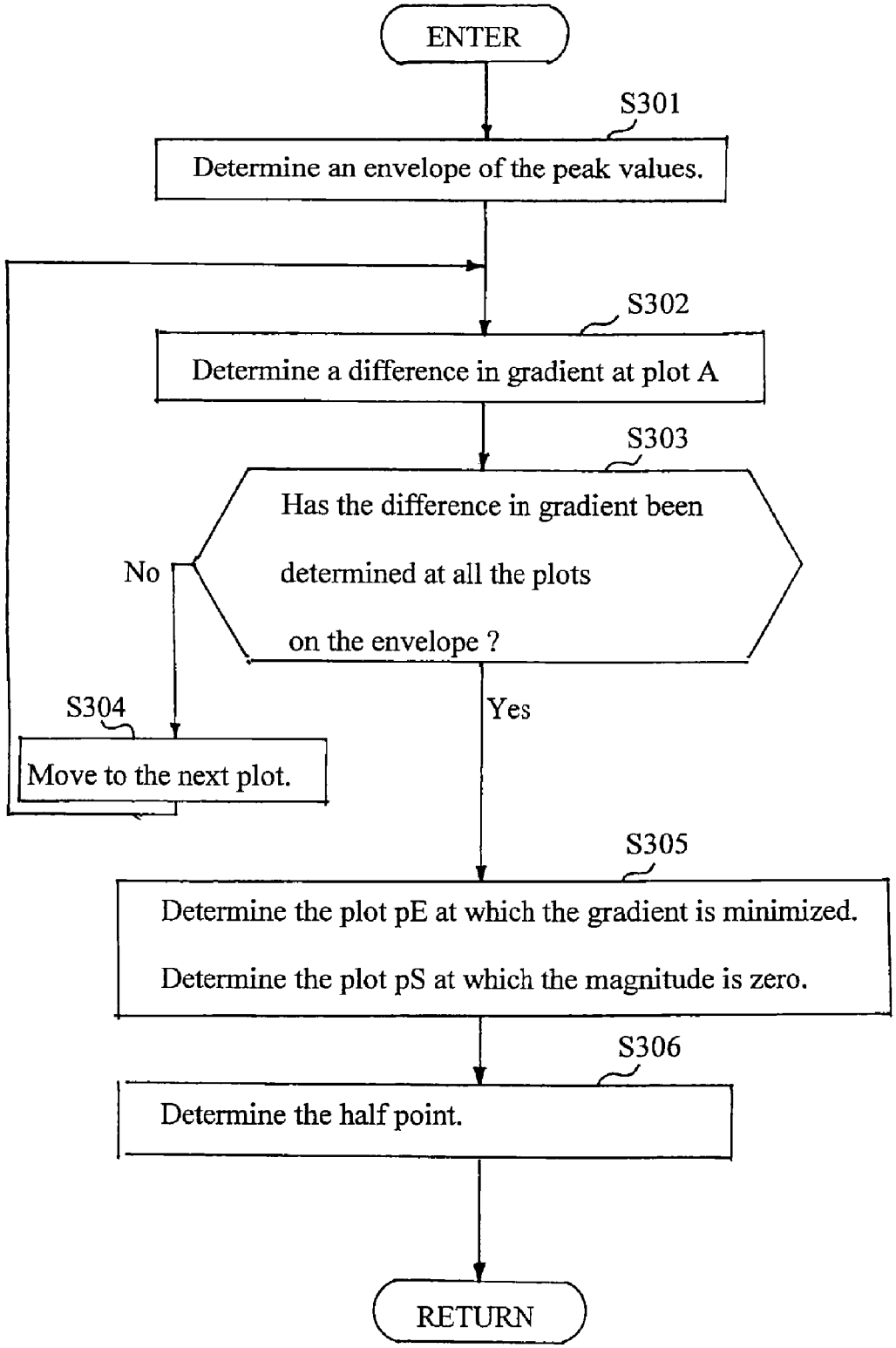
FIG. 11 is a flowchart showing a job sequence for the method.

The testing system of the forth embodiment determines points of reflection stE and pS2 without using the polygonal line approximation. In FIG. 10, CAD stands for a part of an envelope expressing the waveform of acoustic piano tones. The central processing unit specifies a half pedal point through a data processing shown in FIG. 11.

The central processing unit 11 determines the envelope CAD of the peak values as by step S301. As described hereinbefore, the magnitude of detecting signal ys is sampled at time intervals t1 of 4 milliseconds, and the difference in gradient is calculated at plots A corresponding to all of the sampled points. The first plot A is 400 milliseconds later than the plot at the end position. When the central processing unit 11 determines the difference in gradient at a plot A, the central processing unit 11 specifies plots A1 and A2 later than the plot A by a predetermined time t2 of 400 milliseconds, and determines the difference in gradient as by step S302. The difference D in gradient is stored in the random access memory 13, and is expressed as follows.

$$D=\{(\text{Magnitude of detecting signal ys at } A2)-(\text{Magnitude of detecting signal ys at } A)/t2\}-\{(\text{Magnitude of detecting signal ys at } A)-(\text{Magnitude of detecting signal ys at } A1)/t2$$

Subsequently, the central processing unit 11 checks the random access memory 13 to see whether or not the difference D in gradient has been already calculated at all the plots A on the envelope CAD as by step S303. If the central processing unit 11 finds another plot A, the answer at step S303 is given negative "No", and the central processing unit 11 returns to step S302. Thus, the central processing unit 11 reiterates the loop consisting of steps S302 to S304 so that the difference D in gradient is calculated at all the plots A on the envelope CAD.

The central processing unit 11 finally stores the difference D in gradient at the last plot A earlier than the last sampled point by 400 milliseconds in the random access memory 13. Then, the answer at step S303 is changed to affirmative "Yes", and the central processing unit 11 searches the random access memory 13 for the plot pE2 at which the difference D is minimized and for another plot pS2 at which the magnitude of detecting signal ys is decreased to zero as by step S305. The difference D has the maximum negative value at the plot pE2.

Finally, the central processing unit 11 determines the half pedal point through the internal division as similar to the job at step S104.

The testing system implementing the fourth embodiment achieves all the advantages of the first embodiment.

Fifth Embodiment

Figure 12:
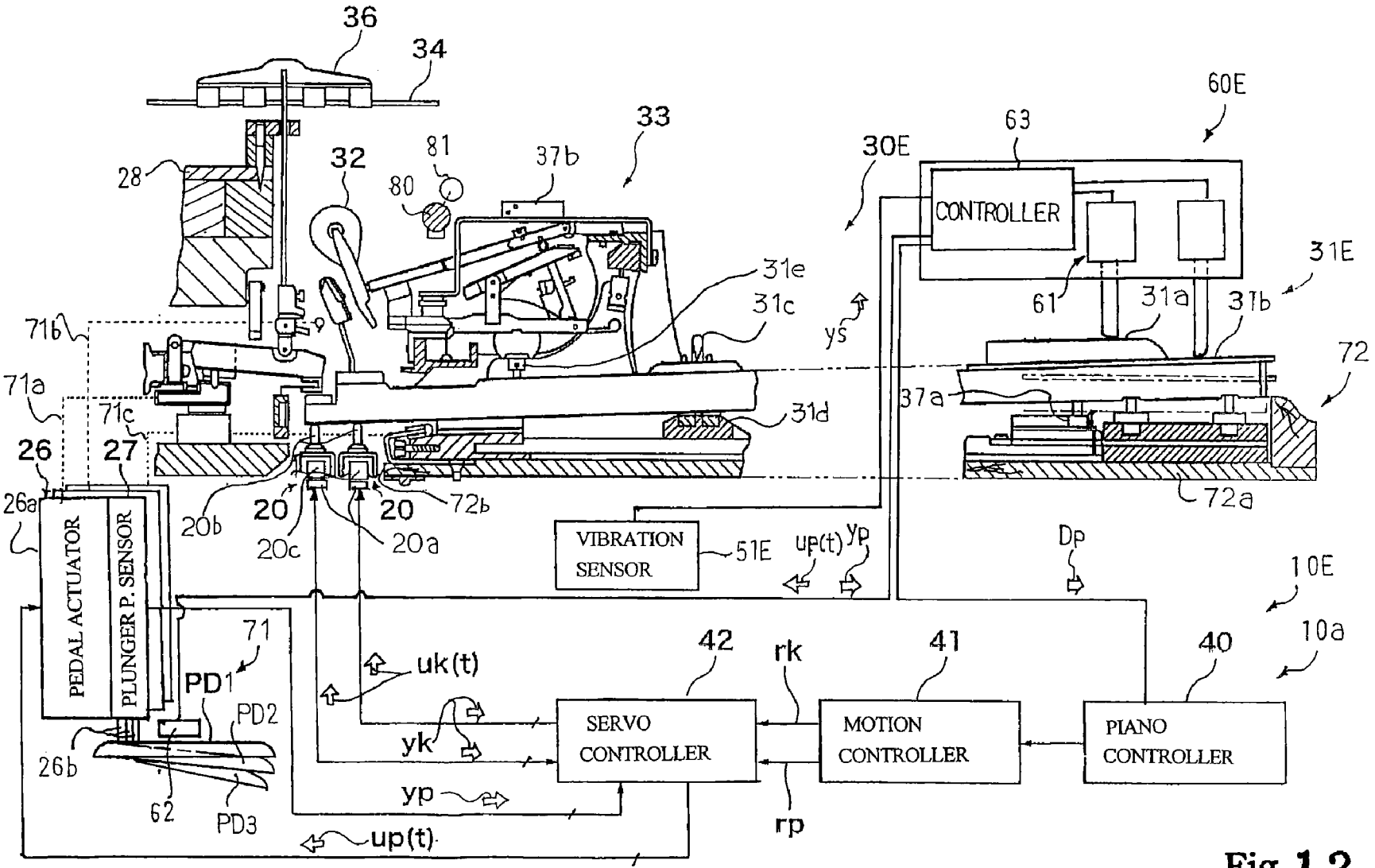
FIG. 12 is a schematic cross sectional view showing a portable testing system on an automatic player piano embodying the present invention.

Turning to FIG. 12 of the drawings, a portable testing system 60E embodying the present invention is mounted on a keyboard 31E of an automatic player piano. The automatic player piano includes an automatic playing system 10E and a grand piano 30E. Component parts of grand piano 30E and System components of the automatic playing system 10E are similar to those of the grand piano 30 and automatic playing system 10. For this reason, the component parts and system components are labeled with references designating the corresponding component parts of grand piano 30 and corresponding system components of automatic playing system 10 without any detailed description for the sake of simplicity.

The portable testing system 60E includes a vibration sensor 51E, solenoid-operated key actuators 61 with built-in sensors, a solenoid-operated pedal actuator 62 with built-in sensor and a controlling unit 63. The vibration sensor 51E is same as the vibration sensor 51. The number of solenoid-operated key actuators is equal to the number of black and white keys 31*a*/31*b* to be moved in the test. The solenoid-operated pedal actuator 62 is combinable with any one of the pedals PD1, PD2 and PD3.

The controlling unit 63 has a data processing capability, and the above-described subroutine program for specifying the half pedal point runs on the controlling unit 63. When the half pedal point is determined, the controlling unit 63 supplies a positional data signal Dp expressing the half pedal point to the piano controller 40, and the piano controller 40 stores the piece of pedal data expressing the half pedal point in the flash memory 25.

The portable testing system 60E achieves all the advantages of the first embodiment. Moreover, the portable testing system 60E is combinable with the automatic player pianos without any testing system so as to make the automatic playing system 10E reenact performances on the grand piano 30E at high fidelity.

Although particular embodiments of the present invention have been shown and described, it will be apparent to those skilled in the art that various changes and modifications may be made without departing from the spirit and scope of the present invention.

The subroutine program for determining the half pedal point may be supplied to the controller from an external program source through a communication network.

Moreover, an external testing system may be independent of the automatic playing system 10. In this instance, the program for determining the half pedal point runs on a microprocessor in the external testing system. The external testing system is communicable with the controller of the automatic playing system 10, and the pieces of test data and pieces of experimental data are transferred between the servo controller 42 and the external testing system.

The combination of piezoelectric element 51, microphone 52 and electromagnetic pickup units 53 does not set any limit to the vibration sensor 51. Any one of the three sorts of vibration-to-electric signal converters may be omitted from the combination. In case where the vibrations of acoustic piano tones are converted to the detecting signal ys through the microphone, the hammer velocity is to be increased due to a poor noise-to-signal ratio of the microphone. In case where the vibrations of acoustic piano tones are converted to the detecting signal ys through the electromagnetic pickup, it is desirable to increase the number of strings 34 to be struck by the hammers 32 in order to make the half pedal point determined through the data processing close to the half pedal point determined by a human worker. Another sort of vibration-to-electric signal converter such as a photo-interrupter may be added to the combination.

More than one piezoelectric element 51 and/or more than one microphone may be incorporated in the combination. In case where plural microphones 52 are provided over the sound board 28, the plural microphones 52 may be spaced from one another in the lateral direction. On the other hand, plural electromagnetic pickup units 53 may be spaced from one another in the fore-and-aft direction.

The black and white keys 31*a*/31*b* driven at step S203 may be more than three. The tones may not form any chord. Only one tone may be produced at step S203.

The strings 34 may be directly excited without any movement of hammers 32. For example, the strings may be electromagnetically excited. In this instance, step S203 is omitted from the job sequence shown in FIGS. 7A and 7B.

The central processing unit 11 may start the timer 26 when the central processing unit 11 instructs the pulse width modulator 10*b* to supply the driving signal up(t) to the solenoid-operated pedal actuator 26. The central processing unit 11 may acknowledge the movement of damper pedal PD1 through the driving pulse signal up(t).

The step S101 may be repeated a predetermined times. In this instance, the central processing unit 11 calculates the average of peak values so as to determine the envelope.

The internal division and the ratio of 2:1 do not set any limit to the technical scope of the present invention. It is possible to specify the half pedal point in the half pedal region. The half pedal point may be specified at the boundary between the restricting region and the half pedal region or the boundary between the half pedal region and the damper free region. The half pedal point stH may be determined through a simple arithmetic operation such as an addition or a subtraction. For example, the half pedal point stH may be determined at a pedal stroke spaced from the boundary between the restricting region and the half pedal region or the boundary between the half pedal region and the damper free region by a predetermined distance.

The damper pedal PD1 may be moved from the rest position toward the end position. In this instance, step S202 is omitted from the job sequence shown in FIGS. 7A and 7B.

The method employed in the fourth embodiment is applicable to the data processing in the third embodiment.

In the fourth embodiment, the half pedal point may be determined on the basis of only the plot pE2, and the difference D in gradient may be calculated for a part of the envelope CAD in which the central processing unit 11 expects the half pedal point to be found.

In the first to fourth embodiments, the central processing unit 11 determines the half pedal point plural times, and finally specifies the half pedal point through an appropriate arithmetic operation such as an averaging.

The uniform motion does not set any limit to the technical scope of the present invention. The damper pedal PD1 may be moved in another sort of motion in so far as the pedal stroke is determinable in terms of time.

The solenoid-operated pedal actuator 26 is not an indispensable feature of the testing system. The pedal may be moved by means of an electric motor or supersonic motor combined with a suitable motion converter such as, for example, a pinion and rack.

The damper pedal PD1 does not set any limit to the technical scope of the present invention. The testing system of the present invention may determine a half pedal point for the soft pedal PD2.

The grand piano does not set any limit to the technical scope of the present invention. The testing system of the present invention may be installed in an automatic player piano fabricated on the basis of an upright piano.

The automatic player piano does not set any limit to the technical scope of the present invention. The testing system may be installed in any sort of automatic player musical instrument in so far as manipulator of the musical instrument is changed to an intermediate position between the reset position and the end position. The testing system may be required for some sorts of automatic player wind instruments.

The subroutine program expressing the method for determining the half pedal point may be offered to users as an information storage medium in which the subroutine program has been stored. Examples of the information storage medium are a floppy disk (trademark), a hard disk, a magneto-optical disk, a CD-ROM, a CD-R, a CD-RW, a DVD-ROM, a DVD-RAM, a DVD-RW, a DVD+RW, a piece of magnetic tape, a non-volatile memory card and a memory stick. The subroutine program may be downloaded from a program source through a communication network.

In case where certain jobs in the subroutine program are accomplished through execution of a part of an operating system, the part of operating system is to be interpreted as a part of the subroutine program.

In case where the subroutine program is written in a memory of an extended board or an extended unit connected to a computer system, a microprocessor on the extended board or in the extended unit cooperates with the central processing unit of the computer system, and the microprocessor is to be interpreted as a part of the central processing unit.

The component parts and system components of the embodiments are correlated with claim languages as follows.

The acoustic piano tones are corresponding to "tones", and the grand pianos 30 and 30E serve as a "musical instrument". The black keys 31*a* and white keys 31*b* are corresponding to "plural manipulators", and the action units 33, hammers 32, strings 34, sound board 28, dampers 36 and link works 71*a*, 71*b* and 71*c* as a whole constitute a "tone generating system". One of the pedals PD1, PD2 and PD3 serve as "another manipulator". To prolong the tone is one of the "effects", and to lesson the loudness of tones is another "effect". The half pedal point stH is corresponding to a "target position". The central processing unit 11, instruction codes for the jobs at step 203 and the solenoid-operated key actuators 20 with built-in plunger sensors 20*c* form in combination an "exciter", and the central processing unit 11, instruction codes for the jobs at steps S202 and S204 to S209 and S211 and solenoid-operated pedal actuator 26 with the built-in plunger position sensor 27 as a whole constitute a "driver". The central processing unit 11, jobs at steps S210, S102 and vibration sensors 51 and 51E serve as a "converter", and the vibrations of sound board 28, vibrations of electric motive force and compression waves of air are recognized as "vibrations expressing the tones". The central processing unit 11 and instruction codes for the jobs at steps S101 to S104 or S301 to S306 as a whole constitute an "information processor". The envelopes CA/CAA/CAD and plots CB/CCB stand for "pieces of experimental data", and the plots pE, pS, pE2 and pS2 are example of "at least one point of reflection".

What is claimed is:

1. An automatic player musical instrument for producing tones without a fingering of a human player in an automatic playing, comprising:

a musical instrument including plural manipulators selectively moved for specifying the tones to be produced, a tone generating system connected to said plural manipulators, and producing said tones specified with the manipulators, another manipulator connected to said tone generating system, and imparting an effect selected from effects to said tones depending upon a current position of said another manipulator;

an automatic playing system activated for said automatic playing and provided in association with said plural manipulators and said another manipulator so as selectively to move said plural manipulators for specifying said tones and said another manipulator for imparting said effect to said tones; and a testing system realized through execution of a subroutine program for a testing operation different from another subroutine program for said automatic playing, activated in said testing operation during said execution of said subroutine program for determining a target position of said another manipulator for imparting one of said effects to said tones through an experiment, informing said automatic playing system of said target position for said automatic playing, and including an exciter giving rise to at least one of said tones through vibrations in said tone generating system, a driver moving said another manipulator for varying said current position, a converter converting vibrations expressing said at least one of said tones to pieces of experimental data expressing magnitude of said vibrations varied together with said current position and an information processor connected to said converter and determining said target position on the basis of at least one point of reflection found in plots expressing relation between said magnitude and said current position.

2. The automatic player musical instrument as set forth in claim 1, in which said target position is determined in a region where said tone generating system imparts said one of said effects to said tones, and said at least one point of reflection is found at a boundary of said region.

3. The automatic player musical instrument as set forth in claim 2, in which said target position is determined through an internal division on the length of said region.

4. The automatic player musical instrument as set forth in claim 2, in which said target position is determined through an addition of a certain distance to at least one point of reflection.

5. The automatic player musical instrument as set forth in claim 1, in which said converter includes at least one device selected from the group including a microphone, a vibration sensor and an electromagnetic pickup.

6. The automatic player musical instrument as set forth in claim 5, in which said device converts said vibrations of said one of said tones and other vibrations of others of said tones concurrently produced together with said one of said tones.

7. The automatic playing musical instrument as set forth in claim 6, in which said one of said tones and said others of said tones form a chord.

8. The automatic playing musical instrument as set forth in claim 1, in which said musical instrument is an acoustic piano having keys serving as said plural manipulators, a pedal serving as said another manipulator and strings serving as parts of said tone generating system.

9. The automatic playing musical instrument as set forth in claim 8, in which said pedal is moved on a trajectory divided into three regions, wherein said tones are prolonged in one of said three regions and decreased in loudness in another of said three regions by means of dampers of said tone generating system.

10. The automatic playing musical instrument as set forth in claim 9, in which said target position is found in said another of said three positions so that said automatic playing system moves said pedal to said target position in an automatic playing for lessening said loudness of said tones.

11. A testing system determining a target position of a manipulator in a testing operation carried out through execution of a subroutine program before an automatic playing carried out through execution of another subroutine program different from said subroutine program, thereby making it possible to impart one of effects to tones produced in an automatic player musical instrument in said automatic playing, comprising:

an exciter giving rise to at least one of said tones through vibrations in a tone generating system of said automatic player musical instrument;

a driver moving said manipulator for varying a current position of said manipulator;

a converter converting vibrations expressing said at least one of said tone to pieces of experimental data expressing magnitude of said vibrations varied together with said current position; and an information processor connected to said converter, and determining said target position on the basis of at least one point of reflection in plots expressing relation between said magnitude and said current position.

12. The testing system as set forth in claim 11, in which said target position is determined in a region where said tone generating system imparts said one of said effects to said tones, and said at least one point of reflection is found at a boundary of said region.

13. The testing system as set forth in claim 12, in which said target position is determined through an internal division on the length of said region.

14. The testing system as set forth in claim 12, in which said target position is determined through an addition of a certain distance to at least one point of reflection.

15. The testing system as set forth in claim 11, in which said converter includes at least one device selected from the group including a microphone, a vibration sensor and an electromagnetic pickup.

16. The testing system as set forth in claim 15, in which said device converts said vibrations of said one of said tones and other vibrations of others of said tones concurrently produced together with said one of said tones.

17. The testing system as set forth in claim 16, in which said one of said tones and said others of said tones form a chord.

18. A method of specifying a target position of a manipulator incorporated in an automatic player musical instrument in a testing operation carried out through execution of a subroutine program for an experiment before an automatic playing carried out through execution of another subroutine program different from said subroutine program, thereby making it possible to impart an effect to tones produced in said automatic player musical instrument in said automatic playing, comprising the steps of:

a) giving rise to at least one tone in said automatic player musical instrument in said testing operation;

b) moving said manipulator so as to vary a current position of said manipulator in said testing operation;

c) accumulating pieces of experimental data expressing relation between magnitude of vibrations representative of said at least one tone and said current position during the movement of said manipulator in said testing operation;

d) searching said piece of experimental data for at least one point of reflection in said testing operation; and e) specifying said target position on the basis of said at least one point of reflection in said testing operation.

19. The method as set forth in claim 18, in which said step d) includes the sub-steps of d-1) determining an envelope of peak values of said magnitude of vibrations, d-2) approximating said envelope to a polygonal line, d-3) determining said at least one point of reflection at a crossing point of the component lines of said polygonal line.

20. The method as set forth in claim 18, in which said step d) includes the sub-steps of d-1) determining an envelope of peak values of said magnitude of vibrations, d-2) calculating a difference in gradient on both sides of a plot on said envelope, d-3) calculating said difference on both sides of another plot on said envelope, d-4) repeating said sub-step d-3) until the difference in gradient is calculated at a certain number of plots on said envelope, and d-5) determining said at least one point of reflection at the plot at which said difference in gradient is minimized.

* * * * *